US010107087B2

(12) United States Patent
Wesenberg et al.

(10) Patent No.: US 10,107,087 B2
(45) Date of Patent: Oct. 23, 2018

(54) PRODUCING HYDROCARBONS FROM A SUBSURFACE FORMATION

(71) Applicant: STATOIL PETROLEUM AS, Stavanger (NO)

(72) Inventors: Margrete Hånes Wesenberg, Ranheim (NO); Håkon Høgstøl, Jakobsli (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/121,901

(22) PCT Filed: Feb. 27, 2015

(86) PCT No.: PCT/EP2015/054215
§ 371 (c)(1),
(2) Date: Aug. 26, 2016

(87) PCT Pub. No.: WO2015/128497
PCT Pub. Date: Sep. 3, 2015

(65) Prior Publication Data

US 2017/0067329 A1 Mar. 9, 2017

(30) Foreign Application Priority Data

Feb. 27, 2014 (GB) ..... 1403455.7

(51) Int. Cl.
*E21B 43/30* (2006.01)
*E21B 43/24* (2006.01)
(Continued)

(52) U.S. Cl.
CPC ..... *E21B 43/305* (2013.01); *E21B 41/0035* (2013.01); *E21B 43/24* (2013.01);
(Continued)

(58) Field of Classification Search
None
See application file for complete search history.

(56) References Cited

U.S. PATENT DOCUMENTS 4,444,258 A 4/1984 Kalmar
4,620,592 A 11/1986 Perkins
(Continued)

FOREIGN PATENT DOCUMENTS

WO WO 02/059455 A1 8/2002
WO WO 2006/116096 A1 11/2006

*Primary Examiner* — Anuradha Ahuja
(74) *Attorney, Agent, or Firm* — Birch, Stewart, Kolasch & Birch, LLP

(57) ABSTRACT

A system and method for producing hydrocarbons from a subsurface hydrocarbon-bearing formation. The system includes a production well, at least part of the production well located in a portion of the hydrocarbon-bearing formation. A heating well is also provided, at least part of the heating well located in a portion of the hydrocarbon-bearing formation; wherein the heating well includes a main well and a plurality of smaller bore lateral wells extending into the hydrocarbon-bearing formation. The smaller bore lateral wells improve heat distribution within the formation, and so fewer heating wells are required to achieve the same effect as using heating wells without smaller bore lateral wells.

17 Claims, 6 Drawing Sheets

(51) Int. Cl.

| | |
|---|---|
| ***E21B 41/00*** | (2006.01) |
| ***E21B 43/243*** | (2006.01) |
| *E21B 43/16* | (2006.01) |
| *E21B 43/26* | (2006.01) |

(52) U.S. Cl.
CPC ..... *E21B 43/243* (2013.01); *E21B 43/168* (2013.01); *E21B 43/2401* (2013.01); *E21B 43/2405* (2013.01); *E21B 43/2406* (2013.01); *E21B 43/26* (2013.01)

(56) References Cited

U.S. PATENT DOCUMENTS

| | | | | |
|---|---|---|---|---|
| 7,832,484 | B2 | 11/2010 | Nguyen et al. | |
| 2003/0080604 | A1* | 5/2003 | Vinegar ..... | E21B 43/243 299/14 |
| 2007/0125533 | A1 | 6/2007 | Minderhoud et al. | |
| 2008/0314593 | A1 | 12/2008 | Vinegar et al. | |
| 2009/0145598 | A1 | 6/2009 | Symington et al. | |
| 2009/0308598 | A1 | 12/2009 | Gardes | |
| 2011/0061937 | A1 | 3/2011 | Orban et al. | |
| 2011/0067858 | A1 | 3/2011 | Dreher et al. | |
| 2012/0247760 | A1 | 10/2012 | Wheeler et al. | |
| 2013/0075084 | A1 | 3/2013 | Clark et al. | |
| 2013/0269935 | A1 | 10/2013 | Cao et al. | |

* cited by examiner

PRODUCING HYDROCARBONS FROM A SUBSURFACE FORMATION

TECHNICAL FIELD

The invention relates to the field of producing hydrocarbons from a subsurface oil shale formation, and in particular to arrangements for heating the formation.

BACKGROUND

The term "oil shale" refers to a sedimentary rock interspersed with an organic mixture of complex chemical compounds collectively referred to as "kerogen". The oil shale consists of laminated sedimentary rock containing mainly clay minerals, quartz, calcite, dolomite, and iron compounds. Oil shale can vary in its mineral and chemical composition. When the oil shale is heated to above 260-370° C., destructive distillation of the kerogen (a process known as pyrolysis) occurs to produce products in the form of oil, gas, and residual char. The hydrocarbon products resulting from the pyrolysis of the kerogen have characteristics that are similar to that of other petroleum products. Oil shale is considered to have potential to become an important source for producing liquid fuels and natural gas, to supplement and augment those fuels currently produced from other petroleum sources.

Proposed in situ processes for recovering hydrocarbon products from oil shale resources describe treating the oil shale in the ground in order to recover the hydrocarbon products. These processes involve the circulation or injection of heat and/or solvents within a subsurface oil shale. Heating methods include hot gas or liquid injection, closed loop circulation of hot gas (e.g. flue gas, propane, methane or superheated steam), closed loop circulation of hot liquid, electric resistive heating, dielectric heating, microwave heating, downhole gas burners or oxidant injection to support in situ combustion. Permeability enhancing methods have been proposed including; rubblization, hydraulic fracturing, explosive fracturing, heat fracturing, steam fracturing, and/or the provision of multiple wellbores.

Heating fluids can be one of several types. A molten salt may be used, such as a nitrate or carbonate salt, or a mixture of such salts. An example of a heating fluid is a mixture of 60% $NaNO_3$ and 40% $KNO_3$ with a melting point of 220° C. This mixture can be heated to 450-650° C. before being piped into to the subsurface formation. The return temperature at the surface for reheating is typically around 250-500° C. Other classes of suitable salts include carbonates, halides or other well-known anions. The counterion (cation) should be environmentally benign, essentially in the form of alkali, alkaline earth elements or sink. A further option is an imidazolium based counterion if a low melting temperature is required. In general, a large size counterion gives a low melting point due to reduced coulomb interactions. The use of molten salts as a heat transfer fluid for heating a subsurface formation has been described in U.S. Pat. No. 7,832,484, which also includes several examples of such salts. Note that it is also possible, with due consideration of cracking effects, to use a hydrocarbon as heating medium. The hydrocarbon can be in a gaseous or liquid form.

The heating fluid is returned to the surface. In the surface facilities, the heating fluid is reheated after having been cooled down in the subsurface formation. Furthermore, it may be necessary to remove unwanted impurities in the heating fluid that have been picked up in the subsurface formation. Certain aspects of U-shaped wellbores containing heating fluid in a closed loop heating system have been described in WO 2006/116096.

In situ production of oil and gas from kerogen in the oil shale has not yet been carried out commercially. Both vertical and horizontal heating and production wells are described in various publications. Various configurations and geometries of patterns of heating wells and production wells have been proposed in an attempt to optimize heating of the subsurface formation.

A problem with the heating process is that that the heating rate is very slow. Heat is transported in the subsurface formation mainly by thermal conduction, and is limited by the low thermal conductivity of the oil shale. It is predicted that a subsurface formation may take years to come to suitable temperatures.

The slow and uneven heating rate in the oil shale formation can be addressed by providing a pattern of closely spaced heating wells. The heating wells must be a short distance to adjacent or nearby production wells in order to achieve production within a reasonable time. This high well density leads to high installation costs and high surface footprint.

SUMMARY

It is an object to provide a more efficient system for bringing a subsurface oil shale formation to a required temperature for production of hydrocarbons. The proposed system can lead to a requirement of fewer heating wells and yet achieves a quicker and more uniform heating throughout a subsurface formation.

According to a first aspect, there is provided a system for producing hydrocarbons from a subsurface hydrocarbon-bearing formation. The system comprises a production well, at least part of the production well located in a portion of the hydrocarbon-bearing formation. A heating well is also provided, at least part of the heating well located in a portion of the hydrocarbon-bearing formation; wherein the heating well comprises a main well and a plurality of smaller bore lateral wells extending into the hydrocarbon-bearing formation. An advantage of this arrangement is that the smaller bore lateral wells improve the heat distribution within the formation, and so fewer heating wells are required to achieve the same effect as using heating wells without smaller bore lateral wells.

As an option, a plurality of heating wells is disposed in a pattern around the production well, at least part of each heating well being located in a portion of the hydrocarbon-bearing formation. Each heating well comprises a main well and a plurality of smaller bore lateral wells extending into the hydrocarbon-bearing formation.

As a further option, the pattern of heating wells around the production well is a substantially hexagonal pattern of heating wells. As a further option, the pattern of heating wells around the production well comprises a first pattern of heating wells having lateral heating wells disposed around the production well at a first distance from the production well, and a second pattern of heating wells disposed in a substantially hexagonal pattern around the production well at a second distance to the heating wells of the first pattern. The smaller bore lateral heating wells of the heating wells of the second pattern are optionally longer than the smaller bore lateral heating wells of the heating wells of the first pattern. This further improves heat distribution.

As an alternative option, the pattern of heating wells around the production well is a substantially triangular pattern of heating wells.

As an option, each heating well is arranged to heat the surrounding formation to a temperature sufficient to crack and/or pyrolize kerogen. This temperature is optionally in a range of 100° C. to 600° C.

The heating well is optionally arranged to provide heat using any of steam, molten salt, flue gas, methane, propane, downhole gas burners, electrical heaters, radio frequency heaters, closed loop fluid heating and fluid injection heating. It will be appreciated that any suitable source of heat may be used.

As an option, the hydrocarbon-bearing formation comprises any of an oil-shale formation and an oils-sands formation.

According to a second aspect, there is provided a method of producing hydrocarbons from a subsurface hydrocarbon-bearing formation. The method involves providing a production well, at least part of the production well located in a portion of the hydrocarbon-bearing formation. A heating well is provided, at least part of the heating well located in a portion of the hydrocarbon-bearing formation; wherein the heating well comprises a main well and a plurality of smaller bore lateral wells extending into the hydrocarbon-bearing formation. The subsurface formation is heated using the heating well hydrocarbons are produced at the production well.

As an option, a plurality of heating wells disposed in a pattern around the production well is provided, at least part of each heating well located in a portion of the hydrocarbon-bearing formation. Each heating well comprises a main well and a plurality of smaller bore lateral wells extending into the hydrocarbon-bearing formation. As a further option, the method comprises disposing the pattern of heating wells around the production well in a substantially hexagonal pattern of heating wells. As a further option, the pattern of heating wells around the production well comprises a first pattern of heating wells having lateral heating wells disposed around the production well at a first distance from the production well, and a second pattern of heating wells disposed in a substantially hexagonal pattern around the production well at a second distance to the heating wells of the first pattern. The smaller bore lateral heating wells of the heating wells of the second pattern are optionally longer than the smaller bore lateral heating wells of the heating wells of the first pattern.

As an alternative option, the pattern of heating wells is disposed around the production well in a substantially triangular pattern of heating wells.

As an option, the method, further comprises heating the surrounding formation to a temperature sufficient to crack and/or pyrolize kerogen. This temperature is optionally in the range of 100° C. to 600° C.

Heating the subsurface formation is optionally achieved using any of steam, molten salt, flue gas, methane, propane, downhole gas burners, electrical heaters, radio frequency heaters, closed loop fluid heating and fluid injection heating.

As an option, the method further comprises inducing fractures in the subsurface formation.

The hydrocarbon-bearing formation optionally comprises any of an oil-shale formation and an oils-sands formation.

DETAILED DESCRIPTION

It has been realised that instead of providing many closely spaced heating wells in the subsurface formation, more even heating of the subsurface formation can be achieved using heating wells having a plurality of lateral extensions. For each heating well, the lateral extensions are typically of smaller bore diameter than the main heating well.

The lateral extensions extend into the subsurface formation and a greater volume of the subsurface formation is in proximity to the heating well or its lateral extensions. This improves the homogeneity of heating within the subsurface formation, leading to quicker and more even heating of the subsurface formation without the need to provide a large number of heating wells that have no lateral extension.

Figure 1:
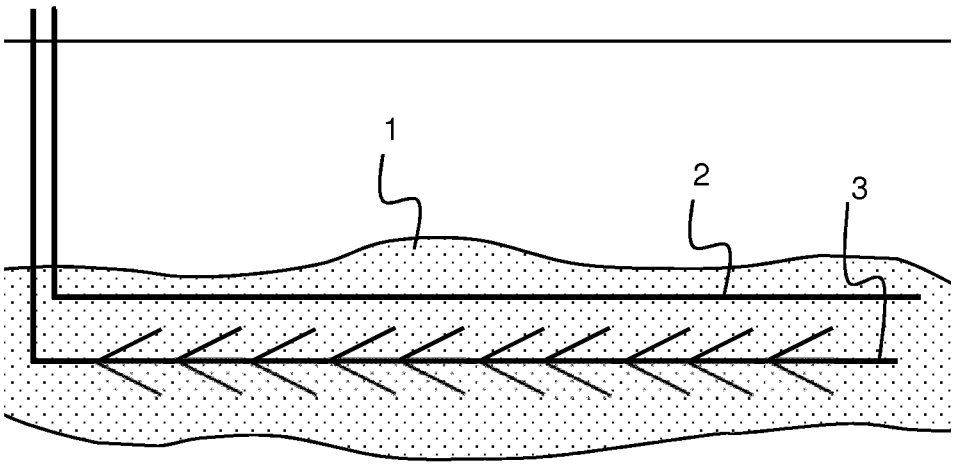
FIG. 1 illustrates schematically a cross section side elevation view of an exemplary production well and heating well.

FIG. 1 illustrates schematically a cross section side elevation view of an exemplary subsurface oil shale formation 1. A production well 2 is located having a substantial portion of the production well 2 disposed in the subsurface formation 1. A heating well 3 is provided having lateral extensions that extend into the subsurface formation 1. In this example, the lateral extensions are thin wells of a given length and angle installed with a given spacing along the main heating well 3. The length of the lateral extensions may be typically 1-24 m and the distance between them may be typically 1-24 m. It is possible to install the lateral extensions in clusters, pointing in all radial directions to further even out the heat distribution in the subsurface formation 1.

As described above, the heating well 3 may operate using any suitable technique, such as hot gas or liquid injection, closed loop circulation of hot gas (e.g. flue gas, methane, propane or superheated steam), closed loop circulation of hot liquid, electric resistive heating, dielectric heating, microwave heating, downhole gas burners or oxidant injection to support in situ combustion. Note that in order to further improve heat distribution, especially in subsurface formations of a low permeability where hot fluid injection is used, fractures may be induced into the subsurface formation to provide flow paths for the heating fluid and any produced hydrocarbons. Fractures may be introduced hydraulically or by heating, and may be held open by the use of proppants.

The heating well 3 is operated to achieve a temperature suitable to pyrolyze kerogen in the subsurface formation. Once pyrolysis has started, hydrocarbons may be produced at the production well 2.

In the example of FIG. 1, only one heating well 3 is shown. Heating of the subsurface formation 1 will be more even and quicker if a plurality of heating wells is provided, each heating well having a plurality of lateral extension wells. Furthermore, several production wells may be provided to better exploit the hydrocarbon resources in the subsurface formation.

Figure 2:
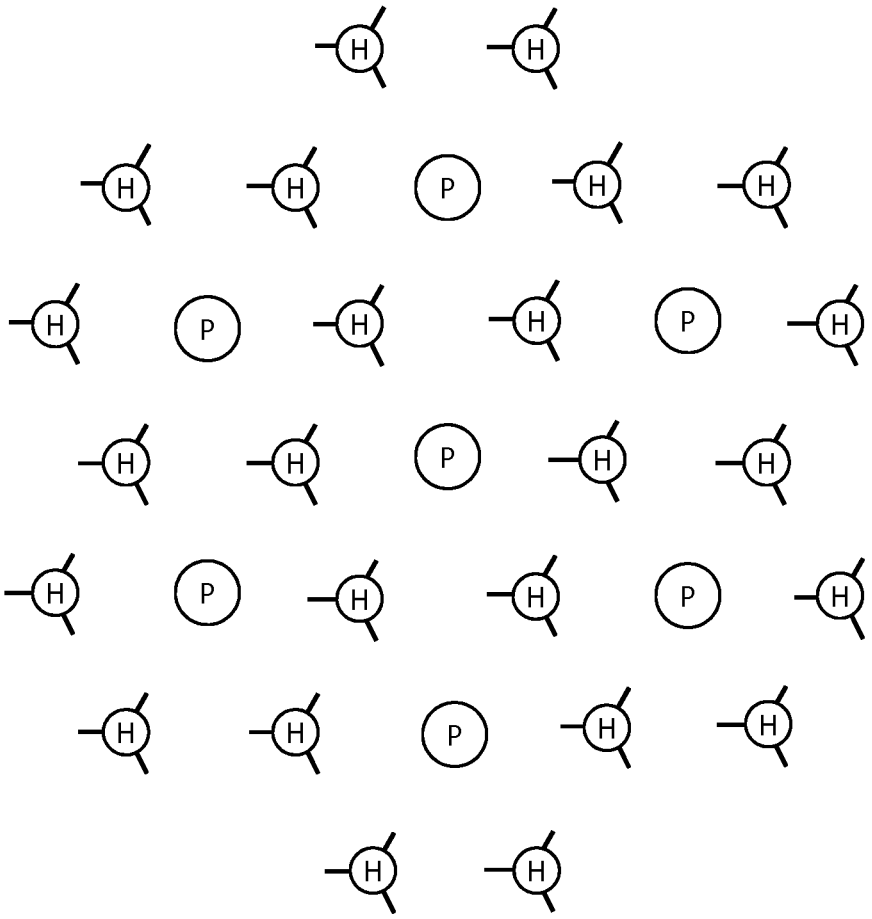
FIG. 2 illustrates schematically a first exemplary pattern of heating wells and production wells shown in cross section perpendicular to a main axis of the wells.
Figure 3:
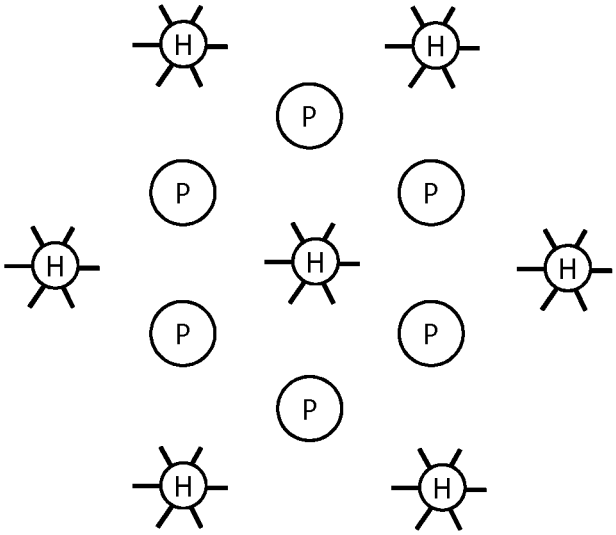
FIG. 3 illustrates schematically a second exemplary pattern of heating wells and production wells shown in cross section perpendicular to a main axis of the wells.
Figure 4:
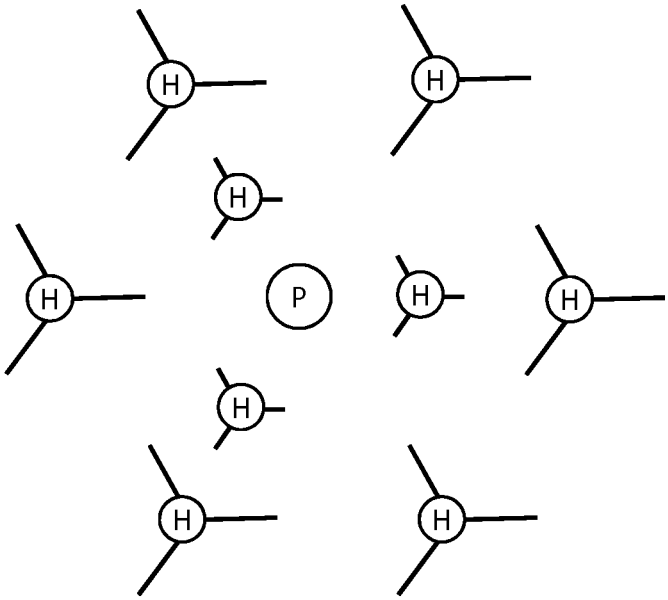
FIG. 4 illustrates schematically a third exemplary pattern of heating wells and production wells shown in cross section perpendicular to a main axis of the wells.

FIGS. 2 to 4 provide exemplary patterns of production wells and heating wells having a plurality of lateral extensions. These figures are shown in cross section perpendicular to a main axis of the wells. It will be appreciated that the wells may be disposed with their main axis substantially vertically, substantially horizontally, or at any suitable angle to take advantage of the properties of the kerogen bearing subsurface formation. The heating wells of FIGS. 2 and 4 are shown with lateral extensions at 120° to one another and in FIG. 3 with angles of 60°, but it will be appreciated that lateral extensions may extend at any angle from the main heating well. The position of lateral wells may be determined by factors such as variations in the properties of the subsurface formation.

All of the patterns shown in FIGS. 2 to 4 are based on repeating patterns of hexagons, but it will be appreciated that other patterns may also be applied. Furthermore, it is possible for patterns to change along the main axis of the wells in order to better exploit the available hydrocarbon resources. The patterns may also show some variation depending on the variation of properties of the subsurface formation.

All examples given in FIGS. 2 to 4 can be adjusted with respect to distances between production and heating wells, length of lateral extensions, exit angle of lateral extensions from main well, build angle for lateral extensions, number of lateral extensions on one cluster, and combinations of different extension lengths and cluster numbers.

Some examples of heating wells having smaller bore lateral extensions disposed in patterns around a production well are given in FIGS. 2 to 4 below:

In the first exemplary embodiment of FIG. 2, a repeating hexagonal structure of heating wells (denoted by the letter "H") is shown. A production well (denoted by the letter "P") is located substantially at the centre of each hexagonal arrangement of heating wells. Each heating well has a plurality of lateral extensions, ensuring that a greater volume of the subsurface formation is exposed to the heat from the heating well.

Despite the fact that each production well is surrounded by six heating wells, the ratio of heating wells to production wells is 2:1 as only a third of each heating well is available to heat each production well.

In the second exemplary embodiment of FIG. 3, a hexagonal arrangement of heating wells is shown. A further heating well is located at the centre of the hexagonal arrangement. Six production wells are disposed in a hexagonal arrangement around the further heating well but inside the hexagonal arrangement of heating wells. Each production well may be thought of as being surrounded by a triangular arrangement of heating wells. The ratio of heating wells to production wells shown in FIG. 3 is 1:2. In the third exemplary embodiment of FIG. 4, an outer hexagonal arrangement of heating wells with long lateral extensions is provided. Within the outer hexagonal arrangement of heating wells, a triangular arrangement of further heating wells having shorter lateral extensions is provided. A production well is provided at the centre of the hexagonal and triangular arrangements. This ratio of heaters to producers is five to one, as only a third of each heating well in the outer hexagonal arrangement provides heat to the region served by the production well and there are three heating wells forming the inner triangular arrangement.

Any of the arrangements shown in FIGS. 2 to 4 may be extended to form a repeating pattern (as shown in FIG. 2) to exploit the resources in the subsurface formation. The patterns shown in FIGS. 2 to 4 are by way of example only, and it will be appreciated that other patterns may be suitable.

The heating wells shown in FIGS. 2 to 4 having lateral radial extensions will heat a much larger volume of the subsurface formation compared to heating wells without lateral extensions. This leads to a requirement of fewer heating and production wells compared with heaters without lateral extensions. This reduces the surface footprint and the well costs.

Figure 5:
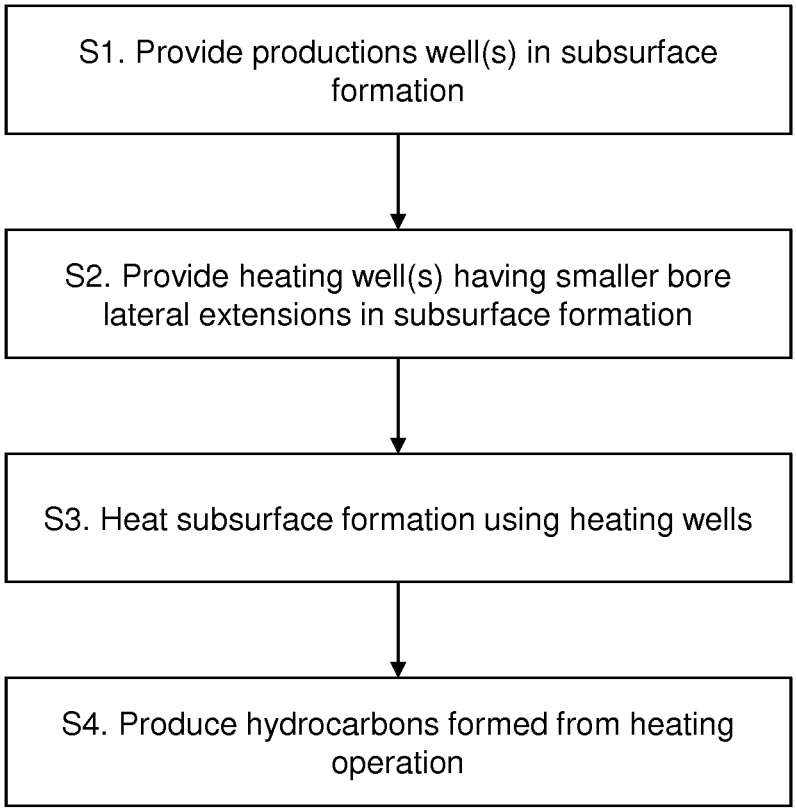
FIG. 5 is a flow diagram showing exemplary steps.

Turning now to FIG. 5, a flow diagram shows exemplary steps. The following numbering corresponds to that of FIG. 5:

S1. One or more production wells are provided that extends into the subsurface reservoir formation.

S2. One or more heating wells having smaller bore lateral extensions are also provided, extending into the subsurface reservoir formation. Typically a plurality of production wells and heating wells are provided to maximise exploitation of the hydrocarbon resources. The wells may be formed in a repeating pattern within the subsurface formation.

S3. The heating wells are used to heat the subsurface formation. This process can take months or years to bring the subsurface formation to the desired temperature.

S4. Hydrocarbons formed by the heating operation are produced at the production well. Note that production of hydrocarbons may be started before finishing the heating operation of step S3.

Figure 6:
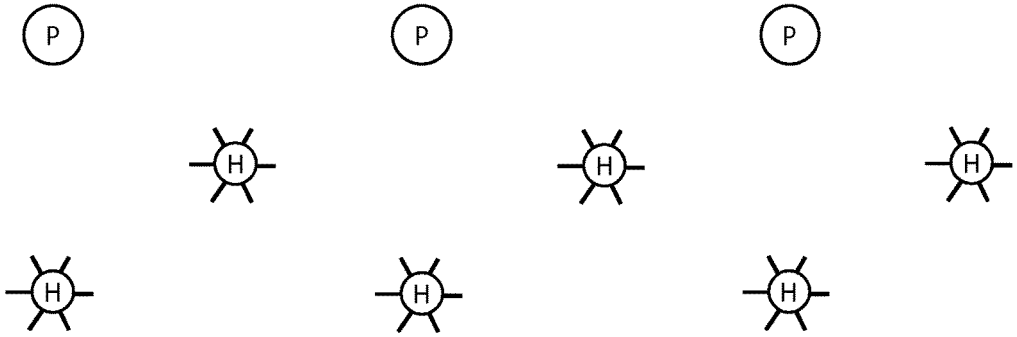
FIG. 6 illustrates schematically a fourth exemplary pattern of heating wells and production wells shown in cross section perpendicular to a main axis of the wells.
Figure 7:
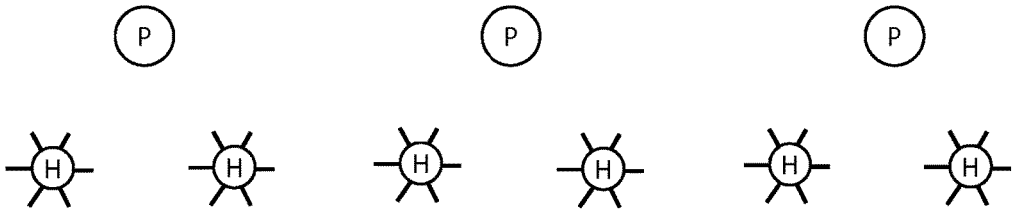
FIG. 7 illustrates schematically a fifth exemplary pattern of heating wells and production wells shown in cross section perpendicular to a main axis of the wells.
Figure 8:
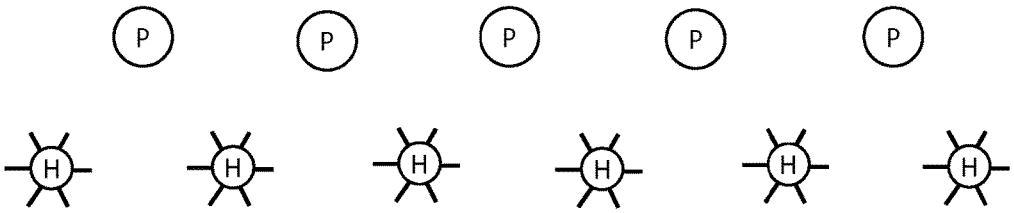
FIG. 8 illustrates schematically a sixth exemplary pattern of heating wells and production wells shown in cross section perpendicular to a main axis of the wells.

The examples of FIGS. 2, 3 and 4 show substantially hexagonal close packed arrangements of heating wells and production wells. It will be appreciated that the same techniques may be applied to other arrangements. In some circumstances, for example where a hydrocarbon-bearing formation is relatively thin, hexagonal arrangements may not be appropriate. FIGS. 6, 7 and 8 illustrate further exemplary arrangements of heating wells and production wells but it will be appreciated that other arrangements may be used.

FIG. 6 shows a fourth exemplary embodiment in which a row of production wells has two offset rows of heating wells with short lateral extensions disposed below it. In this embodiment, the ratio of heating wells to production wells is 2:1. This type of arrangement is suitable for a thin hydrocarbon-bearing formation.

FIG. 7 shows a fifth exemplary embodiment in which a row of production wells has a row of heating wells with short lateral extensions disposed below it. In this embodiment, the ratio of heating wells to production wells is 2:1. This type of arrangement is suitable for a thinner hydrocarbon-bearing formation than the embodiment of FIG. 6.

FIG. 8 shows a sixth exemplary embodiment in which a row of production wells has a row of heating wells with short lateral extensions disposed below it. In this embodiment, the ratio of heating wells to production wells is 1:1. This type of arrangement is suitable for a thinner hydrocarbon-bearing formation than the embodiment of FIG. 6. Furthermore, the lower ratio of heating wells is more suitable for a less permeable formation, as a flow of fluid from the heating well to a production well is slower in a less permeable formation.

On the other hand, where a hydrocarbon-bearing formation is relatively thick, different arrangements may be preferable.

Figure 9:
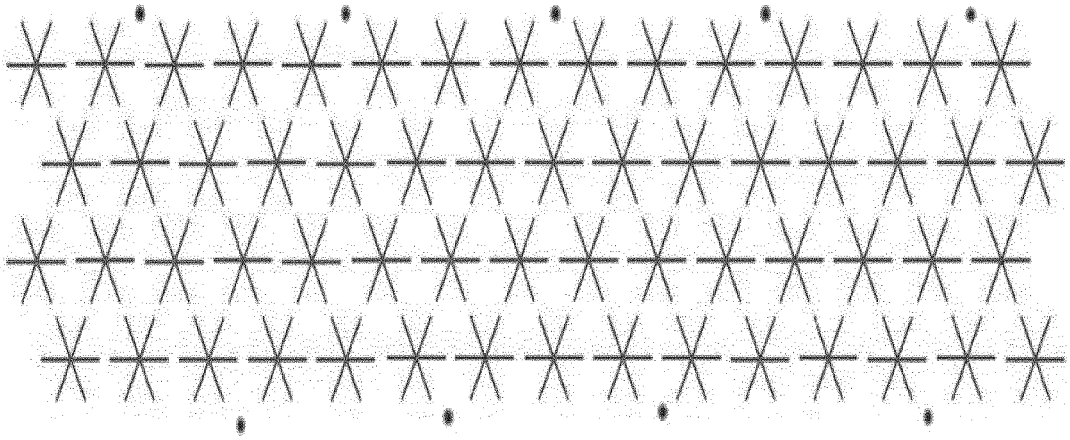
FIG. 9 illustrates schematically a seventh exemplary pattern of heating wells and production wells shown in cross section perpendicular to a main axis of the wells.

In FIG. 9 the locations of the producer wells and the heater wells are indicated schematically by black dots and 6 pointed stars, respectively. In this example the horizontal heaters are arranged in a staggered pattern with horizontal producers spaced apart, in this case with three heater wells in a top row for each producer well. Depending on the conditions there might be two, or four or more heater wells for each producer well. FIG. 9 also shows producer wells in the bottom of the reservoir similarly spaced to collect heavier components; the producer wells at the top of the reservoir principally collecting the lighter products.

In FIG. 10, which again uses stars to indicate the heater well arrangement, shows consecutive arrangements of horizontal heater wells separated by vertical producer wells indicated by the thick black lines. These may be combined with horizontal producer wells (for example in accordance with FIG. 9 and the above discussion), in various combinations.

Figure 10:
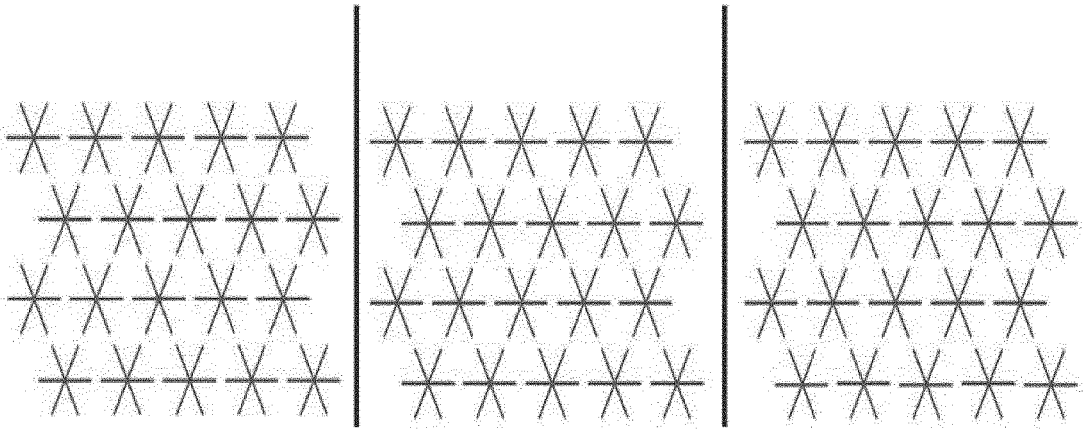
FIG. 10 illustrates schematically a eighth exemplary pattern of heating wells and production wells shown in cross section perpendicular to a main axis of the heating wells.

In FIGS. 9 and 10 the arrangements are exemplary in terms of the number of rows and columns of heater wells and the number and positions of the producer wells.

The benefits from these designs (as exemplified by FIGS. 9 and 10), compared with the previous embodiments are that there are fewer producers per volume of heated oil shale (which can be sufficient if there are high heat transport restrictions compared with flow restrictions), and that the design may give an easier well operation control.

The embodiments of FIGS. 2, 3, 4, and 6 to 10 are all provided by way of example only.

In each of the embodiments the lateral wells along the length of the heating well are shown as equally spaced around the circumference. At any particular cross section along the axis of the well there may be no lateral wells or any convenient number of lateral wells which may be regularly or irregularly spaced around the circumference. For instance, it may be appropriate to have a plurality of lateral wells all directed to one side of a plane through the axis of the main heating well. As previously mentioned there may be one number of lateral wells for one portion of the length of the main bore and a greater number or lesser number of lateral wells for another portion of the length of the heating well.

It should be understood that the term "hydrocarbon" present in the subterranean formation is used in a broad meaning of the term, i.e. not only covering material and compounds that are strictly composed of only hydrogen and carbon atoms, but also to a larger or smaller extent contains heteroatoms that typically are oxygen, sulphur or nitrogen, but also minor amounts of phosphorous, mercury, vanadium, nickel, iron or other elements can be present.

The above systems and methods to improve heat treatment are described using kerogen as an example, but it will be appreciated that similar techniques may be used on any hydrocarbon bearing subsurface reservoir formation. Examples of such subsurface formations include formations containing low viscosity or low mobility hydrocarbons such as bitumen, e.g. in oil sands, heavy oil, extra heavy oil, tight oil, kerogen and coal. Oils are often classified by their API gravity, and a gravity below 22.3 degrees is regarded as heavy, and below 10.0° API as extra heavy. Bitumen is typically around 8° API.

It will be appreciated by the person of skill in the art that various modifications may be made to the above-described embodiments without departing from the scope of the present invention.

Example: Results of Simulations of Heat Conductions with and without Lateral Extensions The inventors have also modelled the difference between the performance of a system including the reduced bore lateral extensions in accordance with the present invention in comparison to the performance of a system using heater wells absent any lateral extensions.

Design: Reservoir layer with horizontal heaters placed in hexagon pattern.

Input Data:

Initial temperature: 40° C.

Heater temperature (main+extensions): 550° C.

Rock data: $\rho$=2000 kg/m$^3$, Cp=850 J/kg K, k=1.2 W/m K

Results:

1. Case without lateral extensions (comparative example)

No lateral extensions

Temperature (T) in the middle of middle hexagon: 147° C. (3 years) and 193° C. (4 years)

2. Case with lateral extensions (example)—Clusters of 3 extensions, each extension pointing directly to the center of the hexagon T in the middle of the middle hexagon: 325° C. (3 years) and 396° C. (4 years)

The invention claimed is:

1. A system for producing hydrocarbons from a subsurface hydrocarbon-bearing formation, the system comprising:

at least one production well, at least part of each production well being located in a portion of the hydrocarbon-bearing formation; and a plurality of heating wells disposed in a pattern around each production well, at least part of each of the plurality of heating wells being located in a portion of the hydrocarbon-bearing formation, wherein the heating wells are configured to heat the surrounding hydrocarbon-bearing formation to a temperature to crack and pyrolize kerogen, wherein each heating well comprises a main well and a plurality of smaller bore lateral wells extending into the hydrocarbon-bearing formation, wherein the smaller bore lateral wells of each heating well are grouped in at least one cluster, each cluster comprising at least three smaller bore lateral wells, wherein the smaller bore lateral wells in each cluster point in radial directions in relation to the respective heating well, such that the radial angle between adjacent smaller bore lateral wells in each cluster is 360° divided by the number of smaller bore lateral wells in the cluster, wherein the plurality of heating wells do not intersect with any production well, wherein each heating well forms a closed loop and is connected to a surface facility to reheat a fluid after being cooled down in the subsurface formation, and wherein each production well does not operate as a heating well and each heating well does not operate as a production well.

2. The system according to claim 1, wherein the pattern of heating wells around each production well is a substantially hexagonal pattern of heating wells.

3. The system according to claim 2, wherein the pattern of heating wells around each production well comprises a first pattern of heating wells having lateral heating wells disposed around the respective production well at a first distance from the respective production well, and a second pattern of heating wells disposed in a substantially hexagonal pattern around the respective production well at a second distance to the heating wells of the first pattern.

4. The system according to claim 3, wherein the smaller bore lateral wells of the heating wells of the second pattern are longer than the smaller bore lateral wells of the heating wells of the first pattern.

5. The system according to claim 1, wherein the pattern of heating wells around each production well is a substantially triangular pattern of heating wells.

6. The system according to claim 1, wherein the temperature is in the range of 100° C. to 600° C.

7. The system according to claim 1, wherein each heating well is configured to provide heat using any of steam, molten salt, flue gas, methane, propane, downhole gas burners, electrical heaters, radio frequency heaters, closed loop fluid heating and fluid injection heating.

8. The system according to claim 1, wherein the hydrocarbon-bearing formation comprises any of an oil-shale formation and an oil sands formation.

9. A method of producing hydrocarbons from a subsurface hydrocarbon-bearing formation, the method comprising:

providing at least one production well, at least part of each production well being located in a portion of the hydrocarbon-bearing formation;

providing a plurality of heating wells disposed in a pattern around each production well, at least part of each of the plurality of heating wells being located in a portion of the hydrocarbon-bearing formation; wherein each of the plurality of heating wells comprises a main well and a plurality of smaller bore lateral wells extending into the hydrocarbon-bearing formation, wherein the smaller bore lateral wells of each heating well are grouped in at least one cluster, each cluster comprising at least three smaller bore lateral wells, and wherein the smaller bore lateral wells in each cluster point in radial directions in relation to the respective heating well, such that the radial angle between adjacent smaller bore lateral wells in each cluster is 360° divided by the number of smaller bore lateral wells in the cluster;

heating the subsurface formation using the plurality of heating wells to a temperature sufficient to crack and pyrolize kerogen; and producing hydrocarbons at each production well, wherein the plurality of heating wells do not intersect with any production well, wherein each heating well forms a closed loop and is connected to a surface facility to reheat a fluid after being cooled down in the subsurface formation, and wherein each production well does not operate as a heating well and each heating well does not operate as a production well.

10. The method according to claim 9, further comprising disposing the pattern of heating wells around each production well in a substantially hexagonal pattern of heating wells.

11. The method according to claim 10, wherein the pattern of heating wells around each production well comprises a first pattern of heating wells having lateral heating wells disposed around the respective production well at a first distance from the respective production well, and a second pattern of heating wells disposed in a substantially hexagonal pattern around the respective production well at a second distance to the heating wells of the first pattern.

12. The method according to claim 11, wherein the smaller bore lateral wells of the heating wells of the second pattern are longer than the smaller bore lateral wells of the heating wells of the first pattern.

13. The method according to claim 9, further comprising disposing the pattern of heating wells around each production well in a substantially triangular pattern of heating wells.

14. The method according to claim 9, wherein the temperature is in the range of 100° C. to 600° C.

15. The method according to claim 9, wherein heating of the subsurface formation includes using any of steam, molten salt, flue gas, methane, propane, downhole gas burners, electrical heaters, radio frequency heaters, closed loop fluid heating and fluid injection heating.

16. The method according to claim 9, further comprising inducing fractures in the subsurface formation.

17. The method according to claim 9, wherein the hydrocarbon-bearing formation comprises any of an oil-shale formation and an oil sands formation.

* * * * *